US007864127B2

(12) United States Patent
Parsche

(10) Patent No.: US 7,864,127 B2
(45) Date of Patent: Jan. 4, 2011

(54) BROADBAND TERMINATED DISCONE ANTENNA AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 426 days.

(21) Appl. No.: 12/126,445

(22) Filed: May 23, 2008

(65) Prior Publication Data

US 2009/0289866 A1 Nov. 26, 2009

(51) Int. Cl.
*H01Q 13/00* (2006.01)

(52) U.S. Cl. ..... 343/773; 343/850; 343/860

(58) Field of Classification Search ..... 343/773, 343/850, 860

See application file for complete search history.

(56) References Cited

U.S. PATENT DOCUMENTS

| | | | | |
|---|---|---|---|---|
| 2,175,252 | A | 10/1939 | Carter | 250/33 |
| 2,283,914 | A | 5/1942 | Carter | 250/33 |
| 2,368,663 | A | 2/1945 | Kandoian | 250/33 |
| 3,829,863 | A | 8/1974 | Lipsky | 343/773 |
| 4,423,423 | A | 12/1983 | Bush | 343/803 |
| 4,851,859 | A | 7/1989 | Rappaport | 343/790 |
| 6,429,821 | B1 | 8/2002 | Lewis, Jr. | 343/749 |
| 6,697,031 | B2 * | 2/2004 | Jocher | 343/895 |
| 7,142,166 | B2 | 11/2006 | Martek | 343/773 |
| 7,170,462 | B2 | 1/2007 | Ihara et al. | 343/788 |
| 7,286,095 | B2 | 10/2007 | Parsche et al. | 343/773 |
| 2005/0168393 | A1 * | 8/2005 | Apostolos | 343/773 |
| 2006/0012528 | A1 | 1/2006 | Hoshi et al. | 343/700 |
| 2006/0164305 | A1 * | 7/2006 | Chen et al. | 343/700 MS |

FOREIGN PATENT DOCUMENTS

| | | |
|---|---|---|
| EP | 1460717 | 9/2004 |
| WO | 2008/118192 | 10/2008 |

* cited by examiner

*Primary Examiner*—Douglas W Owens
*Assistant Examiner*—Dieu Hien T Duong
(74) *Attorney, Agent, or Firm*—Allen, Dyer, Doppelt, Milbrath & Gilchrist, P.A.

(57) ABSTRACT

The discone antenna is a small communication antenna with broad voltage standing wave ratio (VSWR) bandwidth. The discone antenna includes a conical antenna element and a disc antenna element adjacent the apex thereof and including a proximal electrically conductive planar member and a spaced apart distal electrically conductive planar member being electrically connected together at respective peripheries thereof defining a folded ground plane. An antenna feed structure is coupled to the disc and conical antenna elements and includes a first conductor coupled to the proximal electrically conductive planar member, and a second conductor coupled to the conical antenna element and to the distal electrically conductive planar member. An impedance element, such as a resistor, may be connected between the second conductor and the distal electrically conductive planar member.

25 Claims, 6 Drawing Sheets

BROADBAND TERMINATED DISCONE ANTENNA AND ASSOCIATED METHODS

FIELD OF THE INVENTION

The present invention relates to the field of antennas, and more particularly, this invention relates to low-cost broadband antennas, omnidirectional antennas, conical antennas, folding and related methods.

BACKGROUND OF THE INVENTION

Modern communications systems are ever more increasing in bandwidth, causing greater needs for broadband antennas. Some may require a decade of bandwidth, e.g. 100-1000 MHz. Some needs (e.g. military needs) may require broadband antennas for low probability of intercept (LPI) transmissions or communications jamming. Jamming systems can use high power levels and the antenna must provide a low voltage standing wave ratio (VSWR) at all times. The bandwidth need may be instantaneous, such that tuning may not suffice.

In the current physics, antenna size and instantaneous gain bandwidth may be limited through a relationship known as Chu's Limit (L. J. Chu, "Physical Limitations of Omni-Directional Antennas", Journal of Applied Physics, Vol. 19, pp 1163-1175 Dec. 1948). Under Chu's Limit, the maximum 3 dB gain fractional bandwidth in single tuned antennas cannot exceed $200\,(r/\lambda)^3$, where r is the radius of a spherical envelope placed over the antenna for analysis, and $\lambda$ is the wavelength. While antenna instantaneous gain bandwidth is fundamentally limited, voltage standing wave ratio (VSWR) bandwidth is not. Thus, in some systems it may be necessary to trade away gain for increased VSWR bandwidth by introducing losses or resistive loading. Losses are required when the antenna must operate beyond Chu's relation, that is, to provide low VSWR at small and inadequate sizes. Without dissipative losses, the single tuned 2 to 1 VSWR bandwidth of an antenna cannot exceed $70.7\,(r/\lambda)^3$.

Multiple tuning has been proposed as an approach for extending instantaneous gain bandwidth, e.g. with a network external to the antenna, such as an impedance compensation circuit. Multiple tuned antennas have complex polynomial responses, rippled like a Chebyshev filter. Although beneficial, multiple tuning cannot be a remedy to all antenna size-bandwidth needs. A simple antenna may provide a "single tuned" frequency response that is quadratic in nature, and Wheeler has suggested a $3\pi$ bandwidth enhancement limit for infinite order multiple tuning, relative single tuning ("The Wideband Matching Area For A Small Antenna", Harold A. Wheeler, IEEE Transactions on Antennas and Propagation, Vol. AP-31, No. 2, Mar. 1983).

The ½ wave thin wire dipole is an example of a simple antenna. It can have a 3 dB gain bandwidth of only 13.5 percent and a 2.0 to 1 VSWR bandwidth of only 4.5 percent. This is near 5 percent of Chu's single tuned gain bandwidth limit and it is often not adequate. Broadband dipoles are an alternative to the wire dipole. These preferably utilize cone radiating elements, rather than thin wires, for radial rather than linear current flow. They are well suited for wave expansion over a broad frequency range, being a self exciting horn. A biconical dipole, having for example, a conical flare angle of $\pi/2$ radians has essentially a high pass filter response from a lower cut off frequency. Such an antenna provides wide bandwidth, and a response of 10 or more octaves is achieved. Yet, even the biconical dipole is not without limitation: the VSWR rises rapidly below the lower cutoff frequency. Low pass response antennas are seemingly unknown in the present art.

Broadband conical dipoles can include dissimilar half elements, such as the combination of a disc and a cone. A "discone" antenna is disclosed in U.S. Pat. No. 2,368,663 to Kandoian. The discone antenna includes a conical antenna element and a disc antenna element positioned adjacent the apex of the cone. The transmission feed extends through the interior of the cone and is connected to the disc and cone adjacent the apex thereof. A modern discone for military purposes is the model RF-291-AT001 Omnidirectional Tactical Discone Antenna, by Harris Corporation of Melbourne, Fla. It is designed for operation from 100 to 512 MHz and usable beyond 1000 MHz. It has wire cage elements for lightweight and ease of deployment.

U.S. Pat. No. 7,170,462, to Parsche, describes a system of broadband conical dipole configuration for multiple tuning and enhanced pattern bandwidth. Discone antennas and conical monopoles may be related to each other by inversion, e.g. one is simply the other upside down. U.S. Pat. Nos. 4,851,859 and 7,286,095 disclose such antennas formed with connectors at the cone and disc, respectively.

Folding in dipole antennas may be attributed to Carter, in U.S. Pat. No. 2,283,914. The thin wire dipole antenna included a second wire dipole member connected in parallel to form a "fold". In FIG. 5 of U.S. Pat. No. 2,283,914 the folded dipole member includes a resistor for the enhancement of VSWR bandwidth. Without the resistor, bandwidth was not enhanced (relative an unfolded antenna of the same total envelope) but there were advantages of impedance transformation and otherwise. Resistor "terminated" folded dipoles were employed in World War II. Later, in U.S. Pat. No. 4,423,423 to Bush, a resistive load was described in a folded dipole fold member. Resistively terminated folded wire dipole antennas may lack sufficient gain away from their narrow resonances.

Conventional discone antennas have broad instantaneous bandwidth but rapidly rising VSWR at frequencies below cutoff. To obtain sufficiently low VSWR at low frequencies, they may be too physically large. The large size may cause insufficient pattern beamwidth at the higher frequencies, and there the pattern may droop or fall below the target. Accordingly, there is a need for a broadband antenna that provides a low VSWR at all radio frequencies, at small size, and that does not suffer from these limitations.

SUMMARY OF THE INVENTION

In view of the foregoing background, it is therefore an object of the present invention to provide an electrically small communication antenna with small size, broad bandwidth, and a low VSWR at many frequencies.

This and other objects, features, and advantages in accordance with the present invention are provided by a discone antenna including a conical antenna element having an apex, a disc antenna element adjacent the apex of the conical antenna element and comprising a proximal electrically conductive planar member and a spaced apart distal electrically conductive planar member being electrically connected together at respective peripheries thereof defining a folded ground plane. An antenna feed structure is coupled to the disc and conical antenna elements and includes a first conductor coupled to the proximal electrically conductive planar member, and a second conductor coupled to the conical antenna element and to the distal electrically conductive planar member.

At least one impedance element, such as a resistive element, may be coupled between the second conductor and the distal electrically conductive planar member. The proximal electrically conductive planar member may include an opening therein, and the second conductor may extend through the opening in the proximal electrically conductive planar member to connect to the distal electrically conductive planar member. The conical antenna element defines an interior space, and the antenna feed structure may extend through the interior space to the apex of the conical antenna element. The second conductor may be connected to the conical antenna element at the apex thereof.

The first conductor and second conductor may define a coaxial transmission feed. The conical antenna element and/or the disc antenna element may comprise a continuous conductive layer or a wire structure. Furthermore, a dielectric material may be provided between the proximal electrically conductive planar member and the distal electrically conductive planar member of the disc antenna element. The proximal electrically conductive planar member and the distal electrically conductive planar member may be defined by a continuous conductive layer, such as a copper layer, surrounding the dielectric material.

The approach may be referred to as a terminated discone antenna or a resistor traded antenna which may include an impedance device such as a resistor and/or inductor placed at a fold. The approach may provide reduced gain above a cutoff frequency being traded for low VSWR below the cutoff frequency to get increased usable bandwidth.

A method aspect is directed to making a discone antenna including providing a conical antenna element having an apex, positioning a disc antenna element adjacent the apex of the conical antenna element and comprising a proximal electrically conductive planar member and a spaced apart distal electrically conductive planar member being electrically connected together at respective peripheries thereof to define a folded ground plane. The method further includes coupling an antenna feed structure to the disc and conical antenna elements including coupling a first conductor to the proximal electrically conductive planar member, and coupling a second conductor to the conical antenna element and to the distal electrically conductive planar member.

The method may include coupling at least one impedance element, e.g. a resistive element, between the second conductor and the distal electrically conductive planar member. An opening may be formed in the proximal electrically conductive planar member, and the second conductor may be extended through the opening in the proximal electrically conductive planar member to connect to the distal electrically conductive planar member.

The conical antenna element defines an interior space, and the method may further include extending the antenna feed structure through the interior space to the apex of the conical antenna element and connecting the second conductor to the conical antenna element at the apex thereof. The method may further include providing a dielectric material between the proximal electrically conductive planar member and the distal electrically conductive planar member of the disc antenna element.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
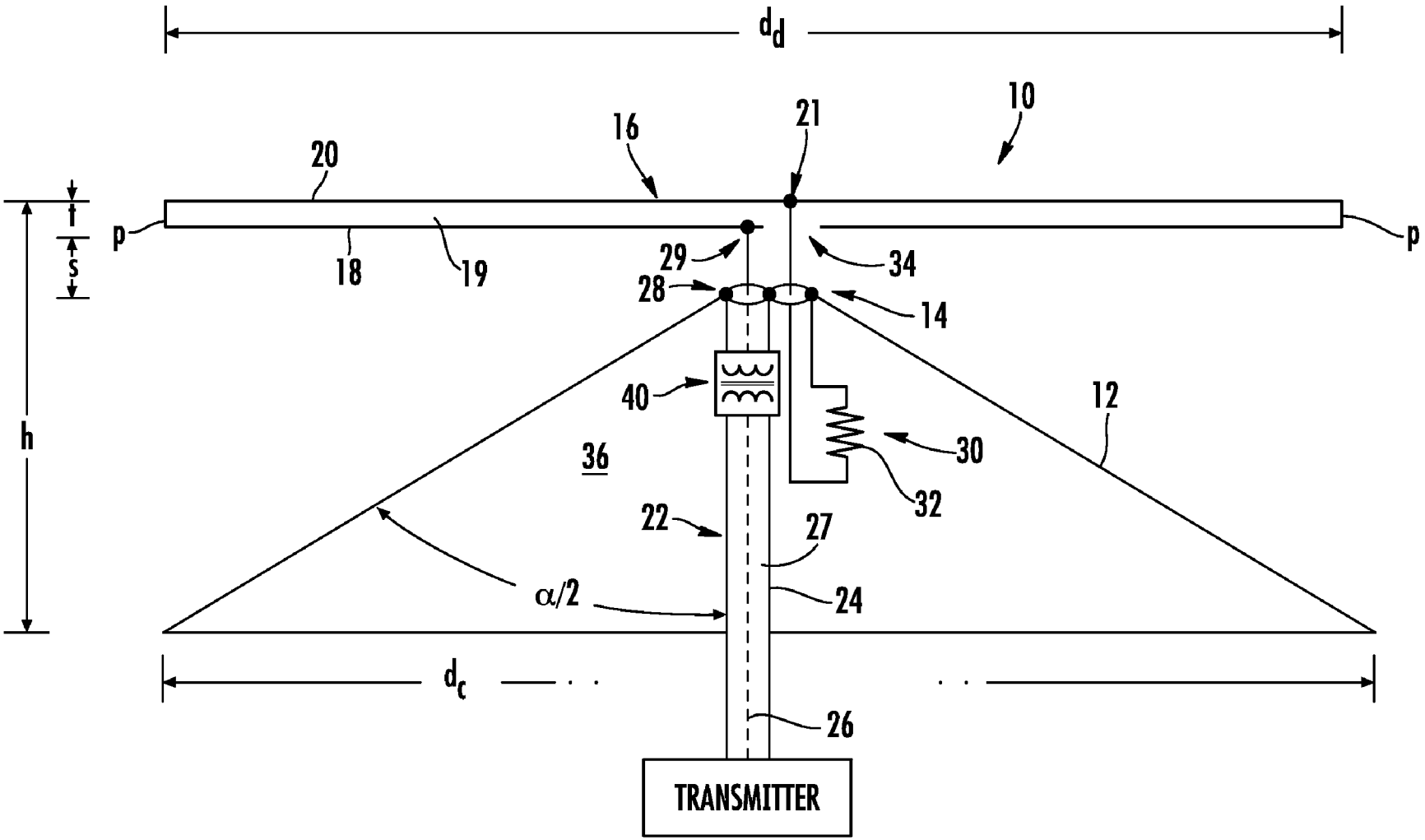
FIG. 1 is a schematic diagram of an exemplary discone antenna according to the present invention.

Referring initially to FIG. 1, a discone antenna 10 in accordance with features of the present invention will be described. The antenna 10 may be used, for example, as a VHF/UHF omnidirectional discone antenna operating between 100 to 512 MHz. The antenna 10 may be referred to as being an electrically small communication antenna with broad VSWR bandwidth. Also, the antenna may be referred to as a terminated discone antenna or a resistor traded antenna which may include a resistor placed at a fold. The antenna 10 may have reduced gain above a cutoff frequency being traded for low VSWR below the cutoff frequency to get increased usable bandwidth. The term "VSWR bandwidth" generally is defined as that bandwidth over which the antenna system does not exceed a maximum value, e.g. 6:1, 2:1, or less. VSWR bandwidth may be measured at the transmitter terminals or the antenna feed points, although as used here the term VSWR can be understood to indicate VSWR at the antenna feedpoints.

The discone antenna 10 includes a conical antenna element 12 having an apex 14. A folded disc antenna element 16 is adjacent the apex 14 of the conical antenna element 12 and includes a proximal electrically conductive planar member 18 and a spaced apart distal electrically conductive planar member 20 being electrically connected together at respective peripheries P thereof defining a folded ground plane. Peripheries P may be for instance, a plated edge. An antenna feed structure 22 is coupled to the conical and folded disc antenna elements 12, 16 at driving points 28, 29, as are common to antennas. An antenna feed structure 22, such as but not limited to a coaxial cable, includes a first conductor 26 coupled to the proximal electrically conductive planar member 18, and a second conductor 24 coupled to the conical antenna element 12 and to the distal electrically conductive planar member 20.

At least one impedance element 30, such as a resistive element 32, is illustratively coupled between the second conductor 24 and the distal electrically conductive planar member 20, at folded node 21. The resistive element may be a 50 ohm load resistor, for example. The proximal electrically conductive planar member 18 includes an opening 34 therein, and a portion of the second conductor 24 illustratively extends through the opening in the proximal electrically conductive planar member to connect to the distal electrically conductive planar member 20, for example, via the resistive element 32. The conical antenna element defines an interior space 36, and the antenna feed structure 22 extends through the interior space to the apex 14 of the conical antenna element, as shown in the illustrated embodiment. The second conductor 24 is also illustratively connected to the conical antenna element 12 at the apex 14 thereof. A transformer 40 or similar RF impedance matching device may be included, e.g. in the antenna feed structure 22, or interposed at driving points 28, 29.

The first conductor 26 and second conductor 24 define a coaxial transmission feed. Such a coaxial transmission feed includes the first conductor 26 being an inner conductor, a dielectric material 27 surrounding the inner conductor, and the second conductor 24 being an outer conductor surrounding the dielectric material, as would be appreciated by those skilled in the art.

Figure 2:
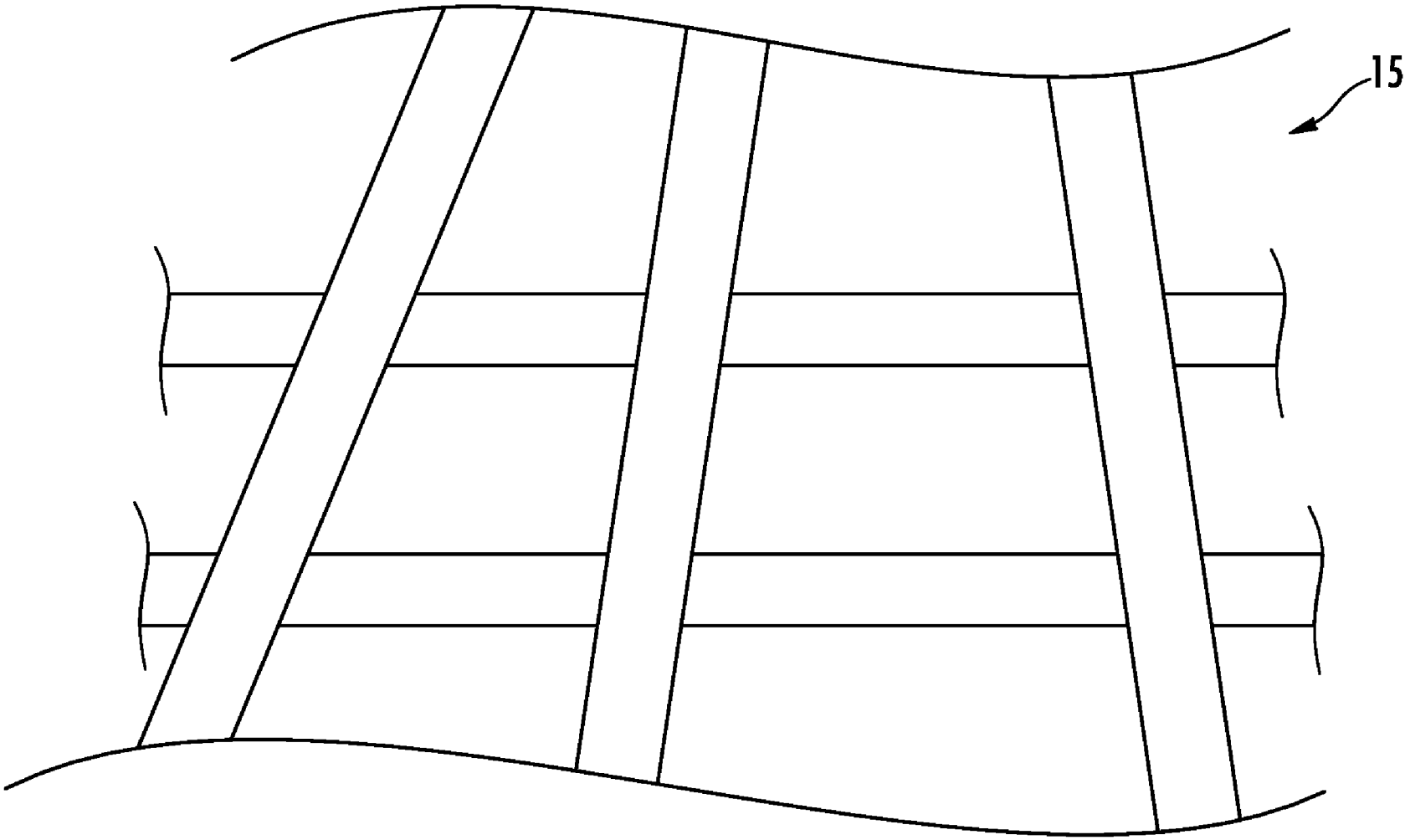
FIG. 2 is an enlarged view of a portion of an exemplary discone antenna according to another embodiment.

The conical antenna element 12 and/or the folded disc antenna element 16 may comprise a continuous conductive layer, as illustrated in FIG. 1, or a wire structure 15 cage as illustrated in the enlarged portion shown in FIG. 2, as would be appreciated by those skilled in the art. Furthermore, a dielectric material 19, e.g. air, solid or a foam rigid material, may be provided between the proximal electrically conductive planar member 18 and the distal electrically conductive planar member 20 of the folded disc antenna element 16. The proximal electrically conductive planar member 18 and the distal electrically conductive planar member 20 may be defined by a continuous conductive layer, such as a copper layer, surrounding the dielectric material 19. Although not detailed, dielectric support structures may also be included with antenna 10 for structural reasons.

Referring to FIG. 1, the parameters of the example embodiment of the present invention antenna 10 are as follows: disc diameter $d_d$=0.18 meters, cone base diameter $d_c$=0.18 meters, height h=0.13 meters, and disc thickness t=0.0038 meters. The conical flare angle $\alpha$ was 90 degrees, making the angle between the disc and the cone 45°. Thus, a wide cone was used. Cone to disc spacing S was $2.5\times10^{-3}$ meters. The disc dielectric fill material 19 was polyimide foam having a relative dielectric constant $\in_r\approx1.4$. The disc was covered with copper foil of $3.5\times10^{-5}$ meters thickness, which was at least one skin depth at all frequencies above 4 MHz, and the disc peripheries P were copper plated to connect proximal electrically conductive planar member 18 and a spaced apart distal electrically conductive planar member 20. Conical antenna element 12 was rolled brass and hollow. Resistive element 32 had a resistance of 50 ohms and negligible reactance. Transformer 40 was not included in the example embodiment, although one may be used if desired, as illustrated. A nominal cutoff frequency ($F_c$) for the example embodiment discone was 360 MHz at 6 to 1 VSWR (about 3 dB mismatch loss) in a 50 ohm system, without resistive loading element 32. At cutoff the electrical size of the antenna was about height h=0.16$\lambda$ and a disc diameter $d_d$=0.22$\lambda$.

Figure 3:
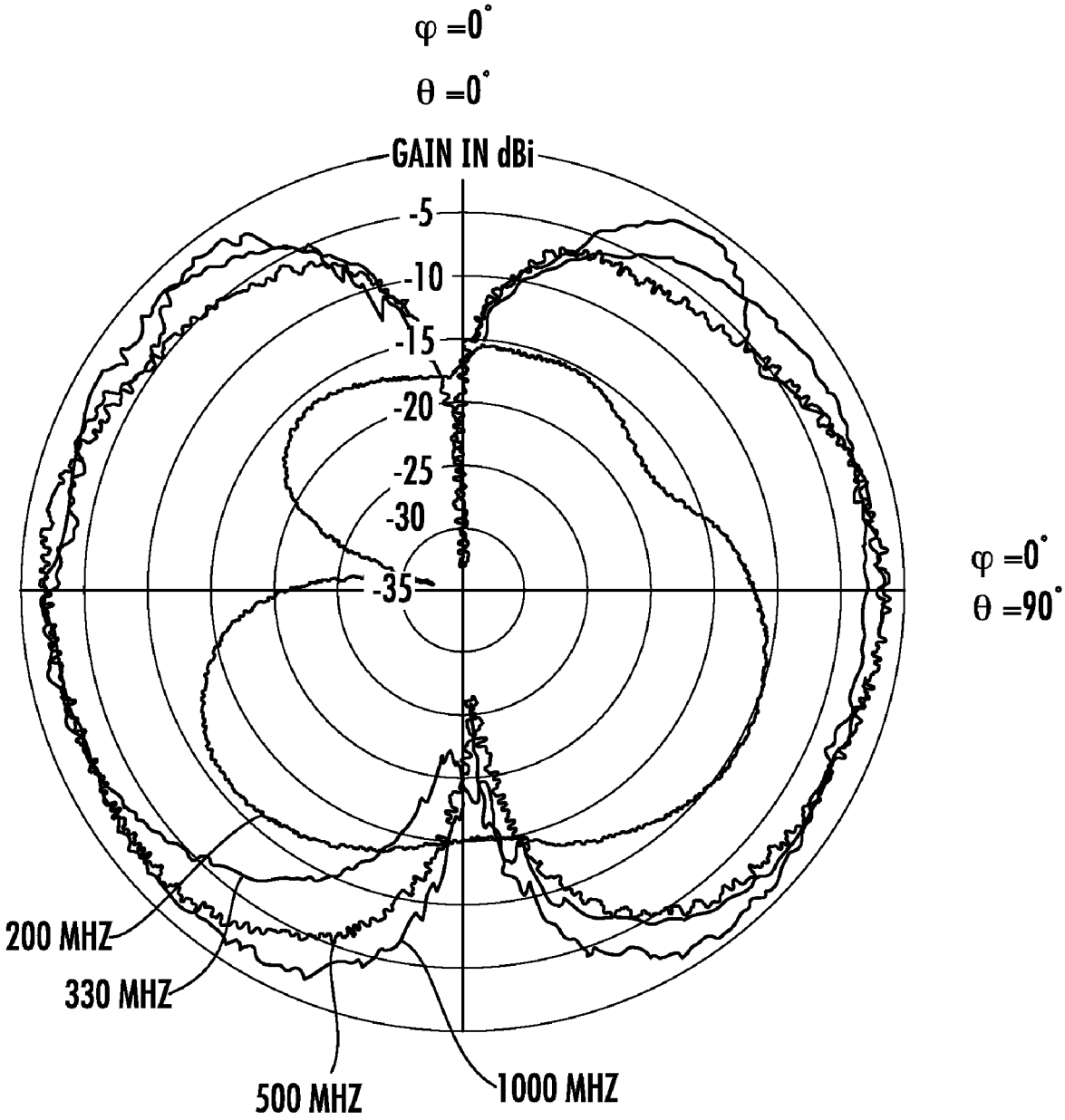
FIG. 3 is a plot of the measured elevation plane radiation patterns of the discone antenna of FIG. 1.

Measured performance of the example embodiment will now be described. A plot of the measured E plane elevation cut radiation patterns at 200 MHz, 330 MHz, 500 MHz and 1000 MHz of the discone antenna 10 of FIG. 1 are shown in FIG. 3. The measurement was taken in an anechoic chamber simulating free space. The plotted quantity is in units of dBi or decibels with respect to isotropic antenna, and the polarization of the range receive antenna was vertical, e.g. only the $E_\theta$ (vertically polarized) fields of the present invention are plotted. E$\phi$ (horizontally polarized radiation) was negligible.

As can be seen, the shape of the radiation pattern of the present invention is identical or nearly identical to that of a conventional discone antenna except for the reduction of amplitude above cutoff. The azimuthal radiation pattern (not shown) for the present invention was circular and omnidirectional as is typical for sheet metal discone antennas. The null in the 330 MHz elevation cut radiation pattern ($\theta$=280°, $\phi$=0°) is as artifact formed by the radiation from common mode currents on the exterior of the coaxial cable feed. Although this is generally beneficial, it could be eliminated with a common mode choke if desired. Pattern droop with frequency, that is the tendency of discone antennas to radiate downward along the cone flare angle, was relatively minor and about 2 decibels at 1000 MHz. This is attributed to the large conical flare angle of conical antenna element 12.

Figure 4:
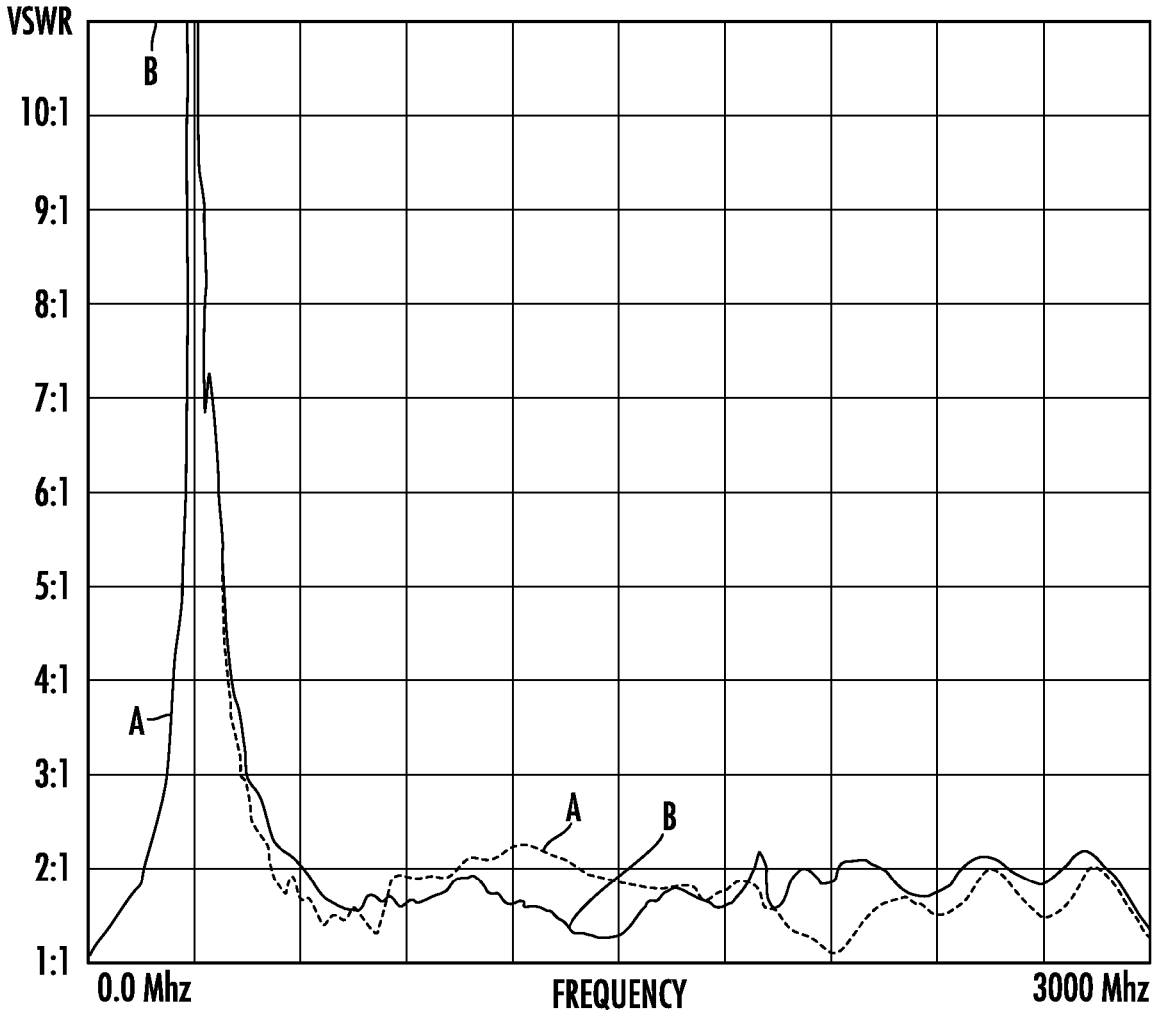
FIG. 4 is a plot of the VSWR response of the discone antenna of FIG. 1 compared to a conventional discone antenna, in 50 ohm systems.

FIG. 4 is a plot of the VSWR response A of the discone antenna 10 of FIG. 1 compared to the VSWR response B of a conventional discone antenna. That is, FIG. 4 is VSWR plot of the same discone antenna with and without resistive element 32 connected. As can be appreciated, the VSWR of the discone antenna 10 approaches 1 to 1 at zero Hz (DC), and it may be a suitable load for transmitting equipment at most or all radio frequencies. There was little rise in VSWR at $1^{st}$ antiresonance (about $2F_c$) due to the wide cone used.

Figure 5:
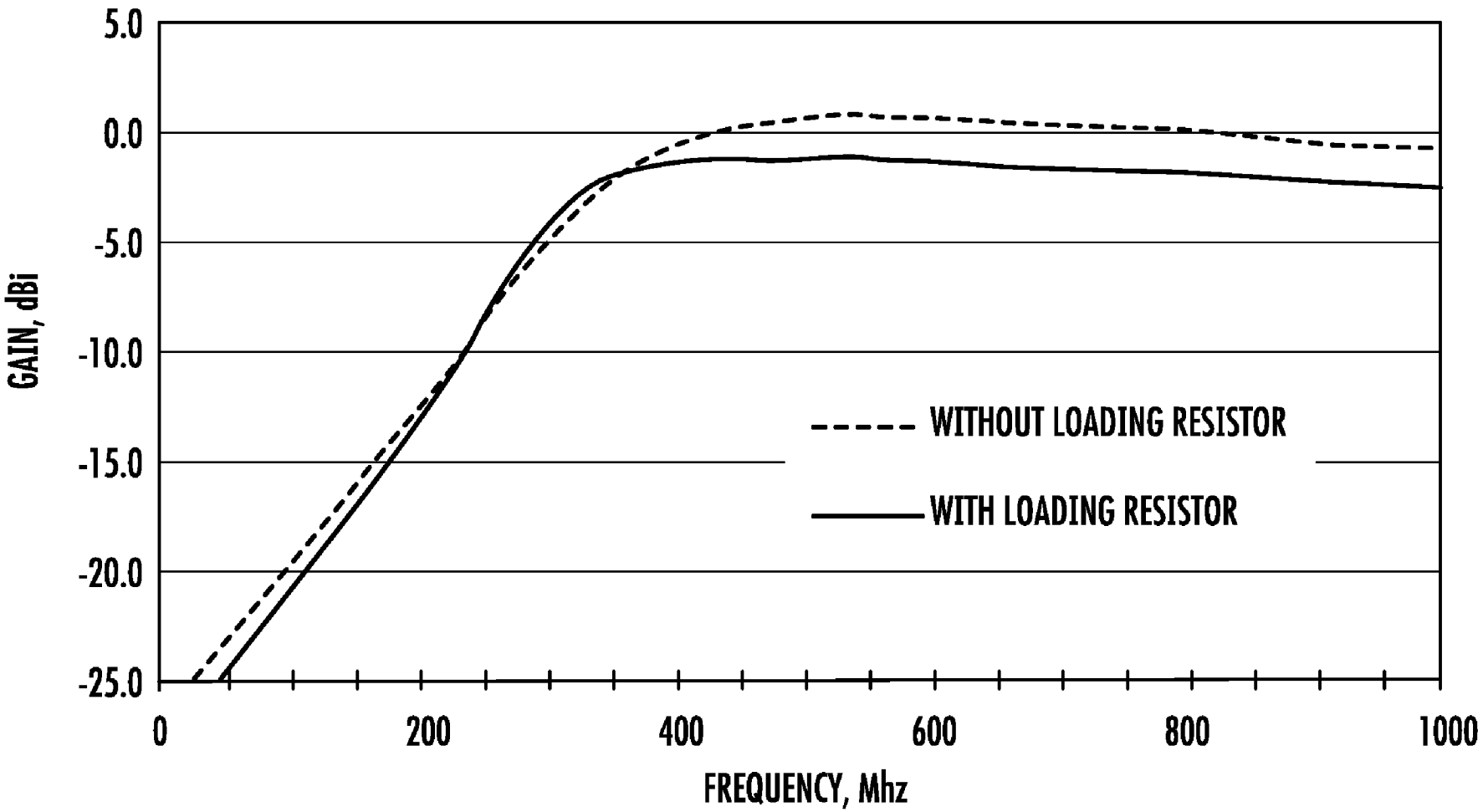
FIG. 5 is a plot of the measured gain on horizon of the discone antenna of FIG. 1 compared to a conventional discone antenna of the same size and shape.

FIG. 5 is a plot of the measured gain C on horizon of the discone antenna 10 of FIG. 1 compared to the measured gain D in the horizontal plane and on the horizon of an identical conventional discone antenna. In other words, FIG. 5 is a gain plot of the same discone antenna with and without resistive element 32 connected. The units in FIG. 5 are those of dBi or decibels with respect to an isotropic antenna. As can be seen, resistive element 32 introduces approximately 1.8 dB of gain loss in the antenna passband above cutoff, which is traded for low VSWR being obtained below cutoff.

Again, the nominal cutoff frequency for the discone antenna 10, without the resistive element 32 was 360 MHz for 6 to 1 VSWR. Interestingly, a tiny enhancement in gain (about 0.5 dBi) was measured near the cutoff frequency when resistive element 32 was connected. This may correspond to increased directivity by modification of current distribution on the radiating structure, e.g. to a more uniform rather than sinusoidal distribution. At small electrical size the elevation plane radiation pattern of antenna 10 becomes similar to the $\cos^2\theta$ two petal rose familiar to those in the art for ½ wave dipoles, with some deviation for feedline radiation if transformer 40 is not of the balun type.

In a trade that would be apparent to those skilled in the art, VSWR can be reduced in most antennas by reducing gain with a resistive attenuator "pad" at the antenna feed point. The present invention is however preferential as it gives lower VSWR with less gain loss then feed point attenuation provides. As can be seen from FIGS. 4 and 5, the inclusion of resistive element 32 in discone 10 caused gain loss above cutoff to asymptotically approach 1.8 dB, while VSWR below cutoff asymptotically approached 1.0 to 1. Using 3 dB T pad attenuator at the antenna feed point instead of resistive element 32 would yield an inferior trade: 3 dB gain loss above cutoff and a VSWR greater than or equal to 3:1 asymptotically below cutoff. The folded disc antenna element 16 and resistive element 32 are thus advantaged relative a resistive element or attenuator at the antenna feed points 28, 29.

The present invention provides a resistive loading trade to meet certain (e.g. military) antenna requirements, such as e.g., spread spectrum communications or instantaneously broadband jamming. Various antennas may be required to provide low VSWR for high transmit powers, and to do at small sizes which are beyond the fundamental limitations in 100 percent efficiency instantaneous gain bandwidth, such that resistive loading is a must. The value of resistive element 32 may be adjusted to trade gain levels above cutoff against VSWR levels obtained below cutoff. Although resistive element 32 was 50 ohms in the example of the present invention, 200 ohms provides a flatter VSWR response with higher gain above cutoff, but higher VSWR below cutoff. Folded node 21 may also be connected to e.g., an inductor or capacitor, a resonant circuit or a ladder network, with or without resistive element 32, for additional adjustment of gain and VSWR response. The driving point resistance of antenna 10 was about 10 ohms at the 330 MHz VSWR maximum when resistive element 32 was included.

At the lowest frequencies antenna 10 becomes of course very small electrically and RF current may conduct or "spill over" beyond conical antenna element 12 and onto antenna feed structure 22, which is typically a coaxial cable. This "spill over" can be beneficial as it provides for enhancement of antenna electrical size and increased radiation. In high power systems this current should be managed for personnel safety by placing a common mode choke (balun) at a point removed from the antenna 10 but also removed from personnel, i.e. part way along the antenna mast. As will be familiar to those in the art, one type of balun is formed by winding a solenoid or helix from coax cable.

Referring to FIG. 1, antenna design parameters include the value of resistive element 32, cone flare angle $\alpha$, disc diameter $d_d$, and cone diameter $d_c$, and height h. Large cone flare angles $\alpha$ in conical antenna element 12 (fat cones) have the advantage of low VSWR at antiresonance ($2F_c$), as tall slender cones go in and out of resonance at octave intervals. A wide fat cone also produces less pattern droop at higher frequencies, as elevation plane pattern lobes of discone antennas can fire downwards along the cones at large electrical size. Fat cones however provide lower driving point resistances. Transformer 22 may be included to reduce VSWR near cutoff for the lower driving point/feed resistances of fatter conical antenna elements 12.

Although the present invention antenna 10 is depicted as a "discone" antenna, with the mouth of conical element 12 downwards and the cone apex 14 upwards, it is not so limited. Present invention antenna 10 may also be inverted to operate as a "conical monopole" with the mouth of conical element 12 upwards and the cone apex 14 downwards, as can be appreciated by those skilled in the art. When antenna 10 is in the inverted or "conical monopole" orientation, some may term the folded disc antenna element 16 a folded ground plane. Folding in antennas can be useful for the configuration of DC or "virtual grounds" for lightning, or EMP protection. For this purpose folded node 21 may be conducted to ground, e.g. by making resistive element 32 zero ohms or a wire jumper.

When antenna 10 is at great electrical size relative wavelength, e.g. at frequencies far above cutoff, the input impedance can be purely resistive and about equal to:

$$R_i = 60 \ln \cot \alpha/4$$

Where:

$R_i$=input impedance of antenna 10

$\alpha$=conical flare angle (FIG. 1)

Cone angle $\alpha$ is thus 94 degrees for 50 ohms at great electrical size and without resistive element 32. With resistive element 32 included, it may be necessary to make cone angle $\alpha$ may be made smaller as the referred value of resistive element 32 appears in parallel. The referred value of resistive element 32 to the antenna 10 driving points 28, 29 is in general complex and varying frequency.

Figure 6:
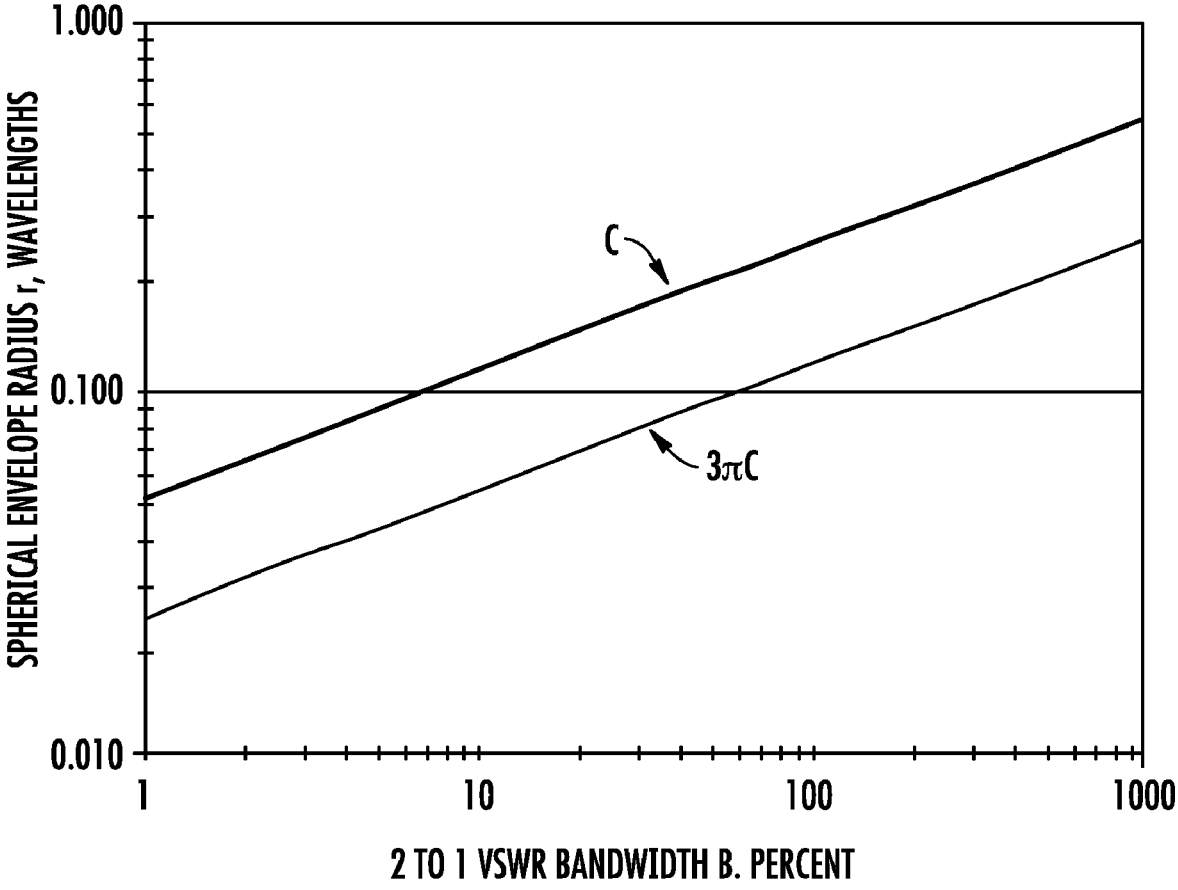
FIG. 6 is a plot of size-bandwidth limitations common and fundamental to antennas, for 2:1 VSWR.

FIG. 6 shows the size-bandwidth limitations common to antennas, which is sometimes known as "Chu's Limit" (again, Chu, "Physical Limitations of Omni-Directional Antennas"). Curve C is for single tuning and $r/\lambda = \sqrt[1/3]{[B/70.7\ (100\%)]}$, and curve 3πC is for infinite order multiple tuning such that $r/\lambda = \sqrt[1/3]{[B/3\pi 70.7\ (100\%)]}$, where B is fractional bandwidth and r is the radius of an analysis sphere enclosing the antenna. Both curves are for 100 percent efficiency, which may be approximate for many discone antenna implementations. The present invention is most directed towards needs in the regions above curves, where sufficient VSWR bandwidth cannot be available from antenna structure alone due to fundamental limitation.

A method aspect is directed to making a discone antenna 10 including providing a conical antenna element 12 having an apex 14, positioning a folded disc antenna element 16 adjacent the apex of the conical antenna element. The disc antenna element includes a proximal electrically conductive planar member 18 and a spaced apart distal electrically conductive planar member 20 being electrically connected together at respective peripheries P thereof to define a folded ground plane. The method further includes coupling an antenna feed structure 22 to the conical and folded disc antenna elements 12, 16 including coupling a first conductor 26 to the proximal electrically conductive planar member 18, and coupling a second conductor 24 to the conical antenna element 12 and to the distal electrically conductive planar member 20.

The method may include coupling at least one impedance element 30, e.g a resistive element 32, between the second conductor 24 and the distal electrically conductive planar member 20. An opening 34 may be formed in the proximal electrically conductive planar member 18, and the second conductor 24, or at least a portion thereof, may be extended through the opening in the proximal electrically conductive planar member to connect to the distal electrically conductive planar member 20, e.g. via resistive element 32.

The conical antenna element 12 defines an interior space 36, and the method may further include extending the antenna feed structure 22 through the interior space to the apex 14 of the conical antenna element 12 and connecting the second conductor 24 to the conical antenna element 12 at the apex thereof. The method may further include providing a dielectric material 19 between the proximal electrically conductive planar member 18 and the distal electrically conductive planar member 20 of the disc antenna element.

The features as described above may provide an electrically small communication antenna with broad voltage standing wave ratio (VSWR) bandwidth at most radio frequencies, even approaching zero Hz or DC. The disc antenna element provides a folded ground plane for the enhancement of VSWR bandwidth, resistive loading, for impedance conversion, and to the other purposes for which antennas are folded such as DC grounding. In addition, many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A discone antenna comprising:

a conical antenna element having an apex;

a disc antenna element adjacent the apex of the conical antenna element and comprising a proximal electrically conductive planar member and a spaced apart distal electrically conductive planar member being electrically connected together at respective peripheries thereof defining a folded ground plane; and an antenna feed structure coupled to the disc and conical antenna elements including a first conductor coupled to the proximal electrically conductive planar member, and a second conductor coupled to the conical antenna element and to the distal electrically conductive planar member.

2. The discone antenna according to claim 1 further comprising at least one impedance element coupled between the second conductor and the distal electrically conductive planar member.

3. The discone antenna according to claim 2 wherein the at least one impedance element comprises at least one resistive element.

4. The discone antenna according to claim 1 wherein the proximal electrically conductive planar member includes an opening therein; and wherein the second conductor extends through the opening in the proximal electrically conductive planar member to connect to the distal electrically conductive planar member.

5. The discone antenna according to claim 1 wherein the conical antenna element defines an interior space, and the antenna feed structure extends through the interior space to the apex of the conical antenna element.

6. The discone antenna according to claim 5 wherein second conductor is connected to the conical antenna element at the apex thereof.

7. The discone antenna according to claim 1 wherein first conductor and second conductor define a coaxial transmission feed.

8. The discone antenna according to claim 1 wherein at least one of the conical antenna element and the disc antenna element comprises a continuous conductive layer.

9. The discone antenna according to claim 1 wherein at least one of the conical antenna element and the disc antenna element comprises a wire structure.

10. The discone antenna according to claim 1 further comprising a dielectric material between the proximal electrically conductive planar member and the distal electrically conductive planar member of the disc antenna element.

11. The discone antenna according to claim 10 wherein the proximal electrically conductive planar member and the distal electrically conductive planar member are defined by a continuous conductive layer surrounding the dielectric material.

12. The discone antenna according to claim 11 wherein the continuous conductive layer comprises a copper layer.

13. A discone antenna comprising:

a conical antenna element having an apex;

a disc antenna element adjacent the apex of the conical antenna element and comprising a proximal electrically conductive planar member, a distal electrically conductive planar member being electrically, and a dielectric material between the proximal electrically conductive planar member and the distal electrically conductive planar member, the proximal electrically conductive planar member and the distal electrically conductive planar member being coupled together at respective peripheries thereof;

an antenna feed structure coupled to the disc and conical antenna elements including a first conductor coupled to the proximal electrically conductive planar member, and a second conductor coupled to the conical antenna element and to the distal electrically conductive planar member; and at least one impedance element coupled between the second conductor and the distal electrically conductive planar member.

14. The discone antenna according to claim 13 wherein the at least one impedance element comprises at least one resistive element.

15. The discone antenna according to claim 13 wherein the proximal electrically conductive planar member includes an opening therein; and wherein the second conductor extends through the opening in the proximal electrically conductive planar member to connect to the distal electrically conductive planar member.

16. The discone antenna according to claim 13 wherein the conical antenna element defines an interior space, and the antenna feed structure extends through the interior space to the apex of the conical antenna element.

17. The discone antenna according to claim 16 wherein second conductor is connected to the conical antenna element at the apex thereof.

18. A method of making a discone antenna comprising:

providing a conical antenna element having an apex;

positioning a disc antenna element adjacent the apex of the conical antenna element and comprising a proximal electrically conductive planar member and a spaced apart distal electrically conductive planar member being electrically connected together at respective peripheries thereof to define a folded ground plane; and coupling an antenna feed structure to the disc and conical antenna elements including coupling a first conductor to the proximal electrically conductive planar member, and coupling a second conductor to the conical antenna element and to the distal electrically conductive planar member.

19. The method according to claim 18 further comprising coupling at least one impedance element between the second conductor and the distal electrically conductive planar member.

20. The method according to claim 19 wherein the at least one impedance element comprises at least one resistive element.

21. The method according to claim 18 further comprising:

forming an opening in the proximal electrically conductive planar member; and extending the second conductor through the opening in the proximal electrically conductive planar member to connect to the distal electrically conductive planar member.

22. The method according to claim 18 wherein the conical antenna element defines an interior space; and further comprising extending the antenna feed structure through the interior space to the apex of the conical antenna element and connecting the second conductor to the conical antenna element at the apex thereof.

23. The method according to claim 18 wherein at least one of the conical antenna element and the disc antenna element comprises a continuous conductive layer.

24. The method according to claim 18 wherein at least one of the conical antenna element and the disc antenna element comprises a wire structure.

25. The method according to claim 18 further comprising providing a dielectric material between the proximal electrically conductive planar member and the distal electrically conductive planar member of the disc antenna element.

* * * * *